US011215195B2

(12) United States Patent
Nakaniwa et al.

(10) Patent No.: US 11,215,195 B2
(45) Date of Patent: Jan. 4, 2022

(54) CENTRIFUGAL COMPRESSOR AND TURBO REFRIGERATOR

(71) Applicant: MITSUBISHI HEAVY INDUSTRIES COMPRESSOR CORPORATION, Tokyo (JP)

(72) Inventors: Akihiro Nakaniwa, Tokyo (JP); Hirofumi Higuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 86 days.

(21) Appl. No.: 16/497,634

(22) PCT Filed: Feb. 22, 2018

(86) PCT No.: PCT/JP2018/006429
§ 371 (c)(1),
(2) Date: Sep. 25, 2019

(87) PCT Pub. No.: WO2018/180057
PCT Pub. Date: Oct. 4, 2018

(65) Prior Publication Data

US 2020/0032811 A1 Jan. 30, 2020

(30) Foreign Application Priority Data

Mar. 31, 2017 (JP) ..... JP2017-069540

(51) Int. Cl.
*F04D 29/44* (2006.01)
*F04D 17/12* (2006.01)

(52) U.S. Cl.
CPC ..... *F04D 29/44* (2013.01); *F04D 17/12* (2013.01)

(58) Field of Classification Search
CPC ..... F04D 29/44; F04D 29/441; F04D 29/444; F04D 17/12; F04D 17/122
See application file for complete search history.

(56) References Cited

U.S. PATENT DOCUMENTS 4,735,551 A * 4/1988 Schilling ..... F04D 29/441 415/182.1
5,094,085 A 3/1992 Irino
(Continued)

FOREIGN PATENT DOCUMENTS

GB 168772 * 9/1921
GB 627072 * 7/1949
(Continued)

OTHER PUBLICATIONS

International Search Report and Written Opinion in corresponding International Application No. PCT/JP2018/006429, dated May 29, 2018 (13 pages).

*Primary Examiner* — Woody A Lee, Jr.
*Assistant Examiner* — Brian O Peters
(74) *Attorney, Agent, or Firm* — Osha Bergman Watanabe & Burton LLP

(57) ABSTRACT

A suction-and-discharge flow path includes a circumferential flow path that extends in an arc shape about an axis and an external communication path that is connected to both ends of the circumferential flow path. The circumferential flow path has a uniform flow path cross-sectional area in a circumferential direction, and a convex curved surface having a convex curved surface shape is provided between an outer peripheral wall surface of the circumferential flow path and a second inner wall surface of the external communication path. In a case where, when viewed in the axis direction, a curvature radius of the convex curved surface is defined as R and a radial dimension of the circumferential
(Continued)

flow path is defined as W, a relationship of $W \leq R \leq 3W$ is established.

14 Claims, 6 Drawing Sheets

(56) References Cited

U.S. PATENT DOCUMENTS 6,273,674 B1 * 8/2001 Charron ..... F04D 31/00
415/169.3
8,105,026 B2 * 1/2012 Eguchi ..... F04D 29/4226
415/204
9,086,002 B2 * 7/2015 Konig ..... F04D 29/665

FOREIGN PATENT DOCUMENTS

JP H04-020751 A 1/1992
JP 2012-251528 A 12/2012

* cited by examiner

CENTRIFUGAL COMPRESSOR AND TURBO REFRIGERATOR

TECHNICAL FIELD

The present invention relates to a centrifugal compressor and a turbo refrigerator.

Priority is claimed on Japanese Patent Application No. 2017-069540, filed on Mar. 31, 2017, the content of which is incorporated herein by reference.

BACKGROUND ART

As an industrial compressor or a centrifugal compressor which is used in a turbo refrigerator or a small-sized gas turbine, a multi-stage centrifugal compressor including an impeller in which a plurality of blades are attached to a disk fixed to a rotary shaft is known. In this multi-stage centrifugal compressor, a pressure energy and a speed energy is applied to gas by rotating the impeller.

In a refrigeration cycle of the turbo refrigerator, the multi-stage centrifugal compressor is used to compress a refrigerant serving as a working fluid. (For example, refer to Patent Document 1).

CITATION LIST

Patent Literature

[Patent Document 1] Japanese Unexamined Patent Application, First Publication No. 2012-251528

SUMMARY OF INVENTION

Technical Problem

Depending on an application of a turbo refrigerator, a multi-stage centrifugal compressor used in the turbo refrigerator has a discharge flow path through which a refrigerant is discharged from an intermediate flow path to the outside or a suction flow through the refrigerant is sucked from the outside to the intermediate flow path. From the viewpoint of efficiency of the multi-stage centrifugal compressor, the discharge flow path is designed to be a low pressure loss when the refrigerant is discharged.

In addition, the suction flow path is designed to be a low pressure loss when the refrigerant is sucked.

Here, depending on a refrigeration process of the turbo refrigerator, the discharge and the suction of the refrigerant may be switched during an operation. Accordingly, it is necessary to separately provide the discharge flow path and the suction flow path in a casing of the multi-stage centrifugal compressor, and a structure is complicated. In addition, the above-described problem is not limited to the turbo refrigerator, and the problem similarly occurs in operation processes of other systems using the multi-stage centrifugal compressor.

The present invention provides a multi-stage centrifugal compressor and a turbo refrigerator capable of coping with various operation processes and maintaining a low pressure loss while avoiding the complication of the structure.

Solution to Problem

According to a first aspect of the present invention, there is provided a centrifugal compressor including: a rotary shaft which is configured to rotate around an axis; impellers which arranged to form a plurality of stages with respect to the rotary shaft in an axis direction and are configured to pressure-feed a fluid flowing in from an inlet on one side in the axis direction to an outside in a radial direction; and a casing which surrounds the rotary shaft and the impellers and has an intermediate flow path through which the fluid discharged from a preceding stage impeller of the impellers adjacent to each other is introduced into a subsequent stage impeller and a suction-and-discharge flow path which connects the intermediate flow path and an outside to each other, in which the suction-and-discharge flow path includes a circumferential flow path which extends in an arc shape about the axis in a circumferential direction of the axis and communicates with the intermediate flow path in the circumferential direction, and an external communication path which is connected to both circumferential ends of the circumferential flow path and communicates with the outside, the circumferential flow path has a uniform flow path cross-sectional area in the circumferential direction, a convex curved surface having a convex curved surface shape continuous to an inner wall surface of the external communication path when viewed in the axis direction is provided between an outer peripheral wall surface of the circumferential flow path and an inner wall surface of the external communication path, and in a case where, when viewed in the axis direction, a curvature radius of the convex curved surface is defined as R and a radial dimension of the circumferential flow path is defined as W, a relationship of $W \leq R \leq 3W$ is established.

According to this configuration, it is possible to discharge a working fluid from the intermediate flow path between the preceding stage impeller and the subsequent stage impeller to the outside via the suction-and-discharge flow path. In addition, it is possible to suck the working fluid into the intermediate flow path via the suction-and-discharge flow path from the outside. That is, the suction-and-discharge flow path is used for both discharge and suction of a refrigerant. Accordingly, compared to a case where a flow path for discharge and a flow path for suction are separately provided, a structure can be simplified.

Here, in general, the flow path cross-sectional area of the discharge flow path increases toward a front side in a rotation direction of the rotary shaft and the discharge flow path communicates with the outside while the working fluid in the intermediate flow path is introduced from the entire region of the discharge flow path in the circumferential direction. Accordingly, when the working fluid is discharged from the intermediate flow path, the flow path cross-sectional area increases according to an increase in a flow rate of the working fluid toward the front side in the rotation direction. Accordingly, a low pressure loss is generated.

However, in a case where the working fluid tries to be sucked from the outside via the discharge flow path, the flow path cross-sectional area in the discharge flow path decreases as the working fluid flows. Accordingly, as the working fluid flows in from the outside, a pressure loss increases. Therefore, it is not possible to suck the working fluid from the entire region in the circumferential direction to the intermediate flow path, and an amount of suction at a circumferential position is biased. As a result, the pressure loss increases.

Meanwhile, in the present aspect, the flow path cross-sectional area of the circumferential flow path communicating with the intermediate flow path in the suction-and-discharge flow path is uniform. Accordingly, when the working fluid is discharged from the intermediate flow path, it is possible to decrease the pressure loss when the working fluid is sucked into the intermediate flow path while preventing the pressure loss from increasing. That is, in a case where the suction-and-discharge flow path is used for discharge, for example, compared to a case where the flow path cross-sectional area of the circumferential flow path decreases toward the front side in the rotation direction, the pressure loss decreases. Accordingly, it is possible to prevent the pressure loss when the working fluid is discharged from increasing. Meanwhile, in a case where the suction-and-discharge flow path is used for suction, as the working flow flows in from the outside, the flow path cross-sectional area of the circumferential flow path does not decrease. Accordingly, it is possible to prevent the amount of suction at the circumferential position from being deviated.

Here, in a case where the external communication path and the circumferential flow path in the suction-and-discharge flow path are connected to each other at an acute angle when viewed in the axis O direction, when the working fluid is sucked from the outside, inflow of the working fluid from the external communication path to the circumferential flow path is hindered at the connection location. As a result, the pressure loss increases. In the present embodiment, the connection location between the external communication portion and the circumferential flow path becomes the convex curved surface. Accordingly, it is possible to decrease the pressure loss in a case where the working fluid is sucked. Moreover, particularly, in the present aspect, the relationship of $W \leq R \leq 3W$ is established between the curvature radius R of the convex curved surface and the radial dimension W of the circumferential flow path. That is, the curvature of the convex curved surface is suppressed. Accordingly, the working fluid can be smoothly introduced from the external communication path to the circumferential flow path. That is, it is possible to further prevent the working fluid from being hindered by the connection location, and it is possible to effectively suppress the pressure loss at the time of the suction.

In the aspect, preferably, in a case where a flow path cross-sectional area of the circumferential flow path is defined as A, and a throat area which is a minimum flow path cross-sectional area of a flow path with which the convex curved surface is in contact in the suction-and-discharge flow path is defined as B, a relationship of $2A \leq B \leq 5A$ is established.

Here, a location at which the convex curved surface exists becomes a junction portion between the external communication path and the circumferential flow path. In the case where the suction-and-discharge flow path is used for suction, it is preferable to make the flow path cross-sectional area at the junction portion as large as possible. Accordingly, it is possible to decrease a dynamic pressure of the working fluid via the external communication path. As a result, the working fluid is easily introduced into both side of the external communication path in the circumferential direction, and it is possible to suppress the biasing of the amount of suction in the circumferential direction.

In the present aspect, the relationship is established between the throat area B having the minimum flow path cross-sectional area at the junction portion where the convex curved surface is in contact and the flow path cross-sectional area A of the flow path in the flow direction. Accordingly, the flow path cross-sectional area at the junction location is largely secured. Therefore, it is possible to effectively decrease the dynamic pressure of the working fluid introduced from the outside.

In the aspect, the intermediate flow path may include a diffuser flow path extends radially outward from the preceding stage impeller, a straight flow path which is connected to a downstream side of the diffuser flow path and is curved radially inward, and a straight flow path which is connected to a downstream side of the straight flow path and extends radially inward, and an inner peripheral wall surface of the circumferential flow path may be connected to the straight flow path in the circumferential direction.

In a case where the inner peripheral wall surface of the circumferential flow path is connected to the straight flow path, the working fluid sucked from the outside is introduced into the straight flow path, and thus, a mixing loss increases. That is, a speed component of the working fluid flowing through the straight flow path and a speed component of the working fluid flowing through the circumferential flow path are largely different from each other. Accordingly, the working fluids collide with each other, and thus, the mixing loss increases.

In the present embodiment, the inner peripheral wall surface of the circumferential flow path is connected to the straight flow path through which the working fluid, which has a small speed component relative to the working fluid flowing through the circumferential flow path, flows. Accordingly, it is possible to decrease the mixing loss.

In the aspect, the external communication path may extend from a portion between both ends of the circumferential flow path toward a front side in a rotation direction of the rotary shaft and along a tangential line of the circumferential flow path, and the convex curved surface may be formed between the outer peripheral wall surface of the circumferential flow path and an inner wall surface of the external communication path on the front side in the rotation direction.

In the case of this aspect, it is possible to decrease the pressure loss both at the time of the discharge and at the time of the suction, and particularly, it is possible to largely decrease the pressure loss at the time of the discharge.

In the aspect, the external communication path may extend from a portion between both ends of the circumferential flow path toward a rear side in a rotation direction of the rotary shaft and along a tangential line of the circumferential flow path, and the convex curved surface may be formed between the outer peripheral wall surface of the circumferential flow path and an inner wall surface of the external communication path on the rear side in the rotation direction.

In the case of this aspect, it is possible to decrease the pressure loss both at the time of the discharge and at the time of the suction, and particularly, it is possible to largely decrease the pressure loss at the time of the suction.

In the aspect, the external communication path may extends radially outward from a portion between both ends of the circumferential flow path, and the convex curved surface is formed between the outer peripheral wall surface of the circumferential flow path and an inner wall surface of the external communication path on a front side in a rotation direction of the rotary shaft, and between the outer peripheral wall surface of the circumferential flow path and an inner wall surface of the external communication path on a rear side in the rotation direction.

In the case of this aspect, it is possible to effectively decrease the pressure loss both at the time of the discharge and at the time of the suction.

According to a second embodiment, there is provided a turbo refrigerator including: the centrifugal compressor according to any one of the above-described centrifugal compressors.

Accordingly, depending on a refrigeration process, it is possible to decrease the pressure loss at the time of the discharge and at the time of the suction while capable of discharging the working fluid from the intermediate flow path and sucking the working fluid into the intermediate flow path.

Advantageous Effects of Invention

According to a multi-stage centrifugal compressor and a turbo refrigerator of the present invention, it is possible to cope with various operation processes and maintain a low pressure loss while avoiding complication of a structure.

DESCRIPTION OF EMBODIMENTS

Figure 1:
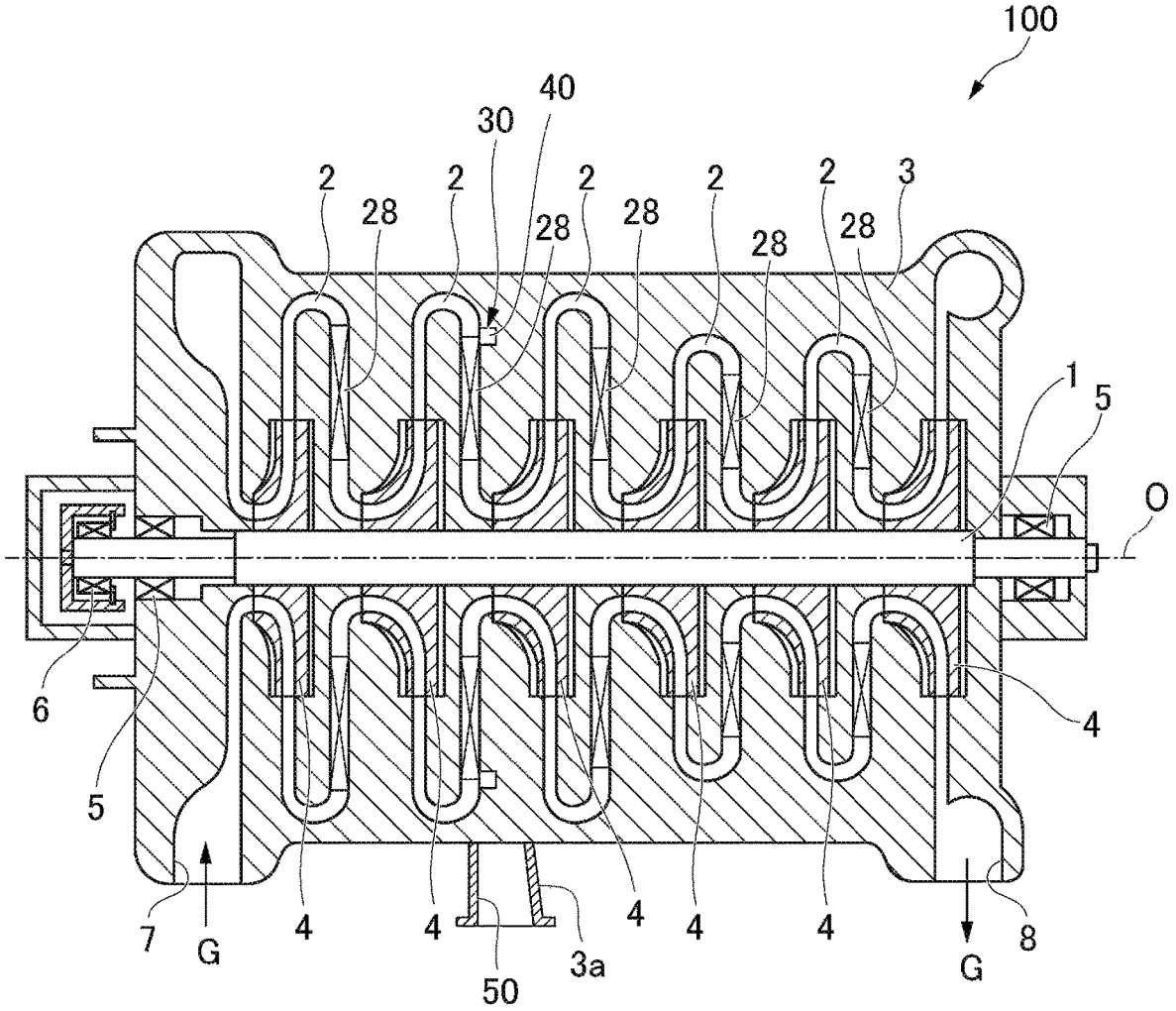
FIG. 1 is a longitudinal sectional view of a centrifugal compressor according to a first embodiment.

Hereinafter, a centrifugal compressor according to a first embodiment of the present invention will be described with reference to the drawings. As shown FIG. 1, a centrifugal compressor 100 includes a rotary shaft 1 which rotates about an axis, a casing 3 which covers a periphery of the rotary shaft 1 to form a flow path 2, a plurality of impellers 4 which are provided on the rotary shaft 1, and return vanes 28 which are provided in the casing 3. In the present embodiment, a suction-and-discharge flow path 30 is formed in the casing 3.

The casing 3 has a cylindrical shape extending along an axis O. The rotary shaft 1 extends to penetrate the inside of the casing 3 along the axis O. A journal bearing 5 and a thrust bearing 6 are provided in both end portions of the casing 3 in an axis O direction. The rotary shaft 1 is supported by the journal bearing 5 and the thrust bearing 6 so as to be rotatable around the axis O.

An intake port 7 for taking in air serving as a working fluid from the outside is provided on one side of the casing 3 in the axis O direction. In addition, an exhaust port 8 through which the working fluid compressed inside the casing 3 is discharged is provided on the other side of the casing 3 in the axis O direction.

An internal space which communicates with the intake port 7 and the exhaust port 8 and whose diameter repeatedly increases or decreases is formed inside the casing 3. The internal space accommodates the plurality of impellers 4 and forms a portion of the flow path 2. Moreover, in the following descriptions, a side on which the intake port 7 is positioned in the flow path 2 is referred to as an upstream side, and a side on which the exhaust port 8 is positioned in the flow path 2 is referred to as a downstream side.

Figure 2:
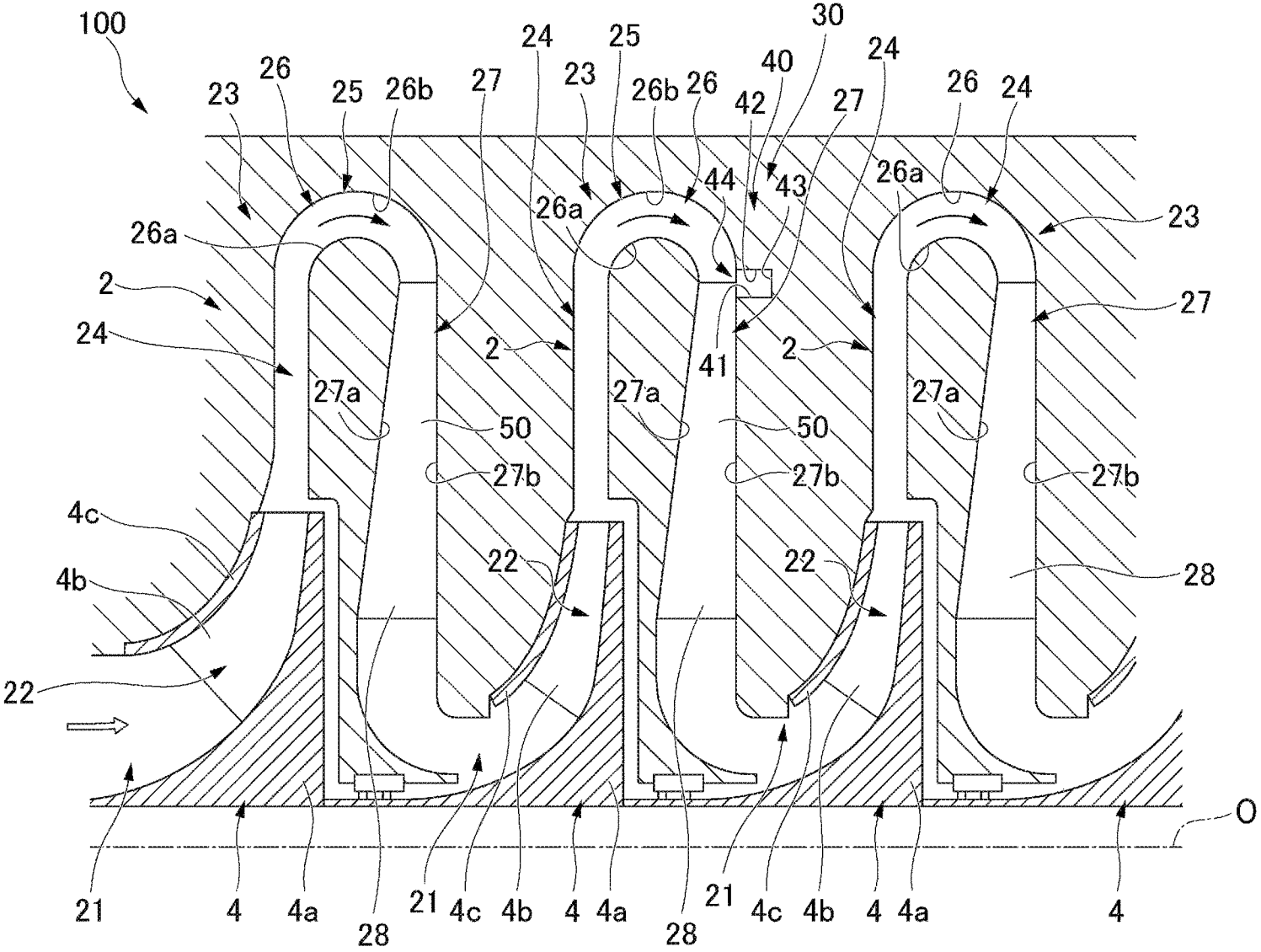
FIG. 2 is a longitudinal sectional view showing the centrifugal compressor according to the first embodiment in a partially enlarged manner.

A plurality (six) of impellers 4 are provided on the outer peripheral surface of the rotary shaft 1 at intervals in the axis O direction. As shown in FIG. 2, each impeller 4 includes a disk 4*a* having a substantially circular cross section when viewed from the axis O direction, a plurality of blades 4*b* which are provided on an upstream surface of the disk 4*a*, and a cover 4*c* which covers the plurality of blades 4*b* from the upstream side.

The disk 4*a* is formed such that a radial dimension of the disk 4*a* gradually increases from one side toward the other side in the axis O direction when viewed from a direction intersecting the axis O, and thus, the disk 4*a* has a substantially conical shape.

The plurality of blades 4*b* are radially arranged outward in the radial direction about the axis O on a conical surface facing the upstream side of both surfaces of the disk 4*a* in the axis O direction. More specifically, each blade is formed of a thin plate which is erected from the upstream surface of the disk 4*a* toward the upstream side. The plurality of blades 4*b* are curved from one side toward the other side in a circumferential direction when viewed in the axis O direction.

The cover 4*c* is provided on upstream end edges of the blades 4*b*. In order words, the plurality of blades 4*b* are interposed between the cover 4*c* and the disk 4*a* in the axis O direction. Accordingly, a space is formed between the cover 4*c*, the disk 4*a*, and a pair of blades 4*b* adjacent to each other. This space forms a portion (a compression flow path 22) of the flow path 2.

The flow path 2 is a space which communicates with the impeller 4 and the internal space of the casing 3 configured as described above. In the present embodiment, a case where one flow path 2 is formed for each impeller 4 (for each compression stage) is described. That is, in the centrifugal compressor 100, five flow paths 2 which are continued from the upstream side toward the downstream side are formed to correspond to five impellers 4 except for the last stage impeller 4.

Each flow path 2 has a suction flow path 21, a compression flow path 22, and an intermediate flow path 23. FIG. 2 mainly shows the first stage impeller 4 to the third stage impeller 4 of the flow paths 2 and the impellers 4.

In the first stage impeller 4, the suction flow path 21 is directly connected to the intake port 7. An external air is taken in each flow path of the flow path 2 as the working fluid by the suction flow path 21. More specifically, the suction flow path 21 is gradually curved radially outward in the axis O direction from the upstream side toward the downstream side.

The suction flow paths 21 of the second and subsequent stage impellers 4 communicate with a downstream end of the intermediate flow path 23 in the preceding stage (first stage) flow path 2. That is, a flow direction of the working fluid which has passed through the intermediate flow path 23 is changed to face the downstream side along the axis O in the same manner as described above.

The compression flow path 22 is a flow path which is surrounded by the upstream surface of the disk 4*a*, a downstream surface of the cover 4*c*, and a pair of blades 4*b* adjacent to each other in the circumferential direction. More specifically, a cross sectional area of the compression flow path 22 gradually decreases from the inside in the radial direction toward the outside. Accordingly, the working fluid flowing through the compression flow path 22 in a state where the impeller 4 rotates is gradually compressed, and thus, the working fluid becomes a high pressure fluid.

The intermediate flow path 23 has a diffuser flow path 24 and a return flow path 25. The diffuser flow path 24 is a flow path which extends from the inside in the radial direction of the axis O toward the outside. A radially inner end portion of the diffuser flow path 24 communicates with a radially outer end portion of the compression flow path 22.

The return flow path 25 has a return bend portion 26 and a straight flow path 27. The return bend portion 26 is a curved shape which causes the working fluid flowing toward the outside in the radial direction to flow toward the inside in the radial direction. The return bend portion 26 reverses the flow direction of the working fluid which flows the inside in the radial direction toward the outside via the diffuser flow path 24 such that the working fluid flows toward in the inside in the radial direction. One end side (upstream side) of the return bend portion 26 communicates with the diffuser flow path 24. The other end (downstream side) of the return bend portion 26 communicates with the straight flow path 27. In a middle of the return bend portion 26, a portion of the return bend portion which is positioned on a radially outermost side becomes a top portion. In the vicinity of the top portion, each of inner curved surface 26*a* which forms an inner portion of a curved surface of a curve of the return bend portion 26 and an outer curved surface 26*b* which forms an outer portion of the curve of the return bend portion 26 is a three-dimensional curved surface, and thus, does not hinder the flow of the working fluid.

The straight flow path 27 extends radially inward from a downstream end portion of the return bend portion 26. A radially outer end portion of the straight flow path 27 communicates with the return bend portion 26. As described above, a radially inner end portion of the straight flow path 27 communicates with the suction flow path 21 in the subsequent stage flow path 2. The straight flow path 27 is formed by a first wall surface 27*a* on one side in the axis O direction and a second wall surface 27*b* on the other side in the axis direction O. The first wall surface 27*a* has a tapered shape whose diameter gradually decreases toward one side in the axis O direction. The second wall surface 27*b* is a flat surface orthogonal to the axis O.

A plurality of return vanes 28 are provided in the straight flow path 27. Specifically, the plurality of return vanes 28 are radially arranged about the axis O in the straight flow path 27. In other words, the return vanes 28 are arranged at intervals in the circumferential direction around the axis O. Both ends of each return vane 28 in the axis O direction is in contact with the casing 3 forming the straight flow path 27, that is, the first wall surface 27*a* and the second wall surface 27*b*.

Figure 3:
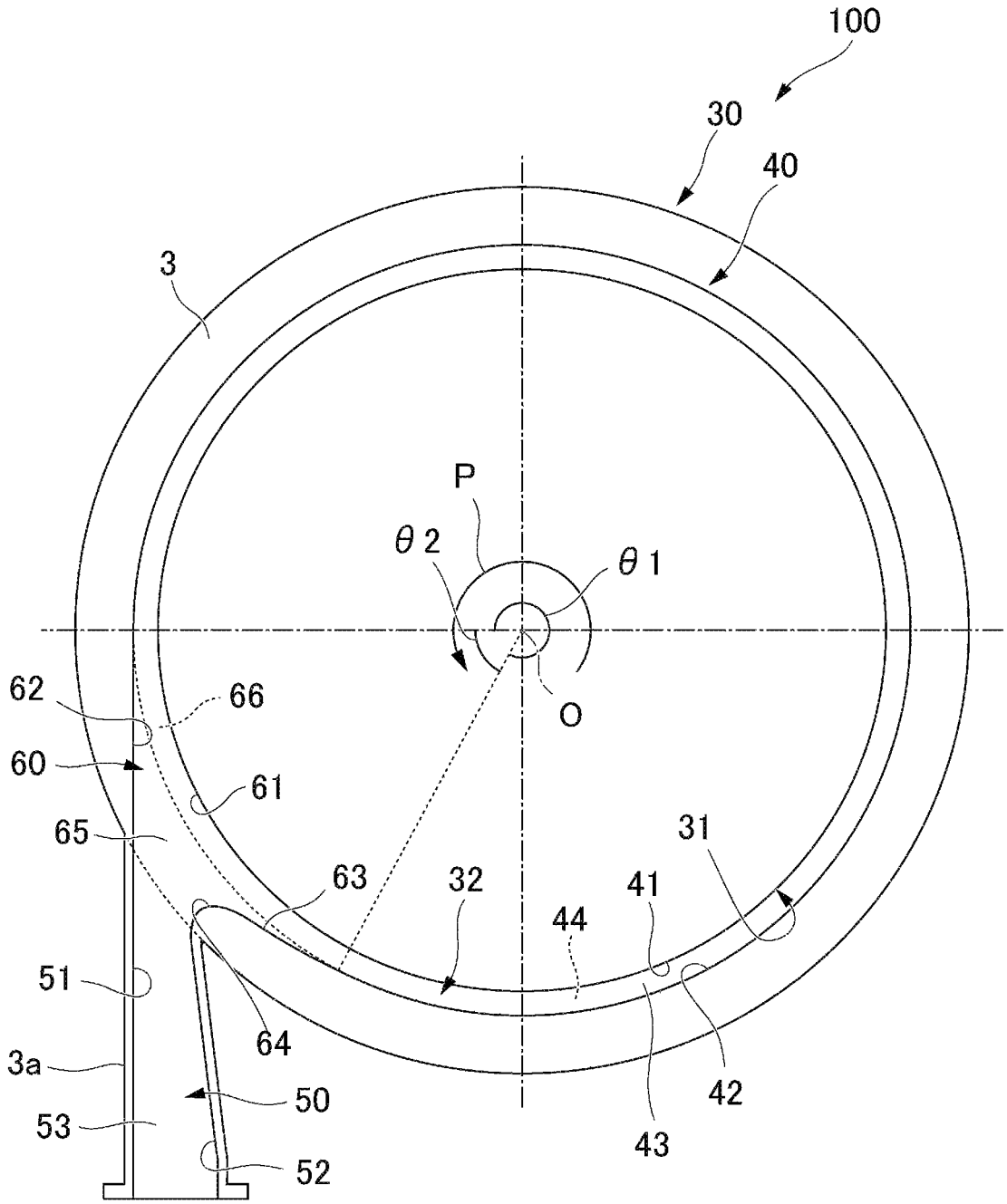
FIG. 3 is a sectional view perpendicular to an axis of a suction-and-discharge flow path of the centrifugal compressor according to the first embodiment.

Next, the suction-and-discharge flow path 30 will be described. As shown in FIG. 3, the suction-and-discharge flow path 30 has a circumferential flow path 40, an external communication path 50, and a connection flow path 60.

Figure 4:
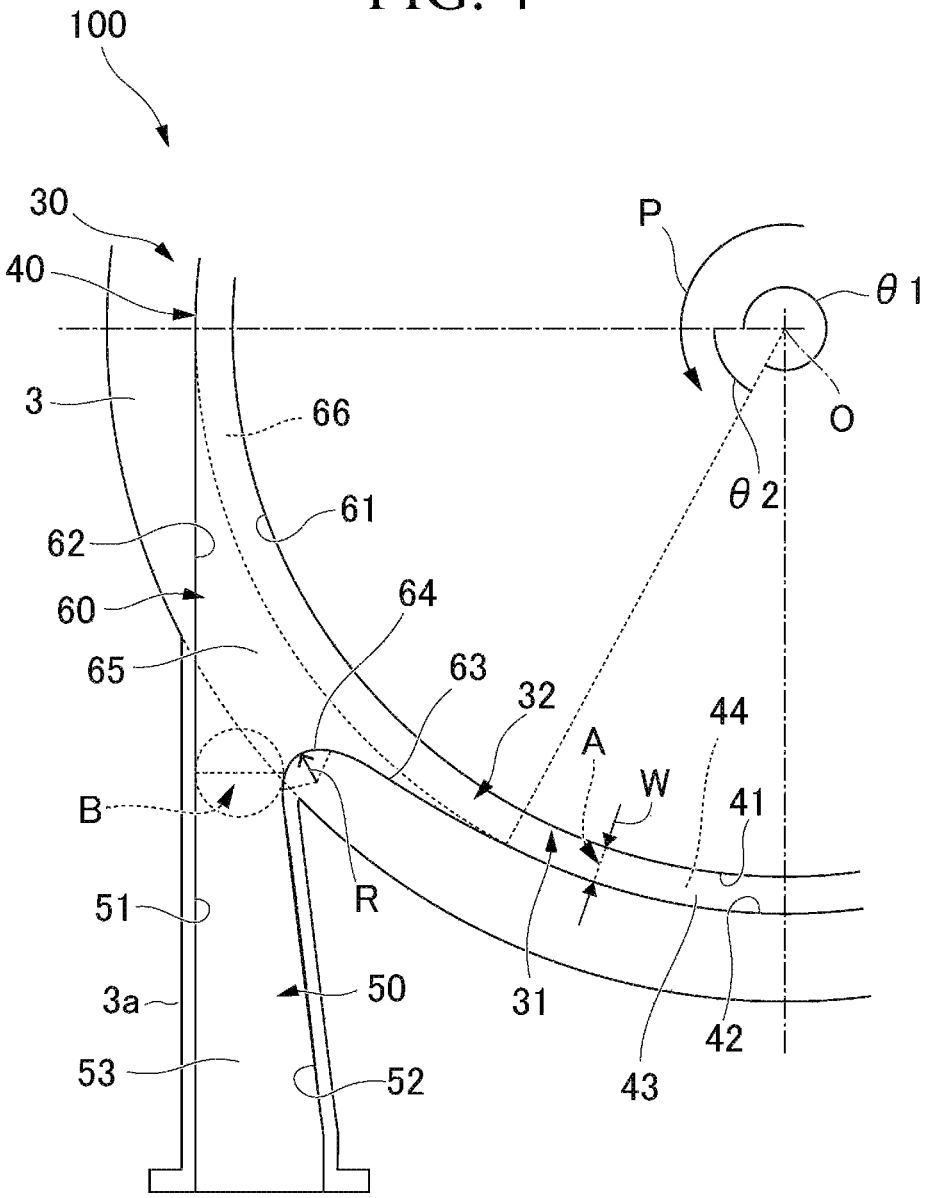
FIG. 4 is a partially enlarged view of FIG. 3.

As shown in FIGS. 3 and 4, the circumferential flow path 40 extends in the circumferential direction of the axis O about the axis O. The circumferential flow path 40 extends in an arc shape over a predetermined angle (a range of an angle θ1 about the axis O) in the circumferential direction. In the present embodiment, the angle θ1 is 270° to 330°, and preferably, 285° to 315°. For example, in the present embodiment, the angle θ1 is set to 300°.

The circumferential flow path 40 is defined by a first inner peripheral wall surface 41, an outer peripheral wall surface 42, and an axially arcuate wall surface 43. The first inner peripheral wall surface 41 defines a radially inner end portion of the circumferential flow path 40. The outer peripheral wall surface 42 defines a radially outer end portion of the circumferential flow path 40. Each of the first inner peripheral wall surface 41 and the outer peripheral wall surface 42 extends in an arc shape over the range of the angle θ1 to be formed in a cylindrical shape about the axis O. An outer diameter of the first inner peripheral wall surface 41 is an inner diameter of the outer peripheral wall surface 42. That is, a radial dimension of the circumferential flow path 40 is determined by a difference between the outer diameter of the first inner peripheral wall surface 41 and the inner diameter of the outer peripheral wall surface 42.

The axially arcuate wall surface 43 defines an end portion on the other side of the circumferential flow path 40 in the axis O direction. The axially arcuate wall surface 43 is formed in a flat surface shape orthogonal to the axis O. The axially arcuate wall surface 43 extends in the circumferential direction about the axis O over the range of the angle θ1. A radially inner end portion of the axially arcuate wall surface 43 is connected to an end portion on the other side of the first inner peripheral wall surface 41 in the axis O direction. A radially outer end portion of the axially arcuate wall surface 43 is connected to an end portion on one side of the outer peripheral wall surface 42 in the axis O direction.

The circumferential flow path 40 is connected to the intermediate flow path 23 to communicate with the intermediate flow path 23 in the entire region in the circumferential direction. As shown in FIG. 2, in the present embodiment, the circumferential flow path 40 is connected to the intermediate flow path 23 between the second impeller 4 and the third impeller 4. More specifically, one side of the circumferential flow path 40 in the axis O direction is open to the return flow path 25 in the intermediate flow path 23 over the angle θ1 of the circumferential flow path 40. The open location becomes an arc-shaped opening portion 44.

In the radially inner end portion of the circumferential flow path 40, that is, in the first inner peripheral wall surface 41 defining an inner diameter portion, an end portion one side in the axis O direction is connected to a second wall surface 27*b* which defines the other side of the straight flow path 27 in the axis O direction. In the present embodiment, the first inner peripheral wall surface 41 of the circumferential flow path 40 is positioned radially inside an upstream end portion of the return vane 28 disposed in the return flow path 25.

In the radially outer end portion of the circumferential flow path 40, that is, the outer peripheral wall surface 42 defining an outer diameter portion, an end portion on one side in the axis O direction is connected to the outer curved surface 26*b* which defines the outside of the curve of the return bend portion 26. In the present embodiment, the outer peripheral surface 42 of the circumferential flow path 40 is positioned radially outside the upstream end portion of the return vane 28 disposed in the return flow path 25. Accordingly, the upstream end portion of the return vane 28 is positioned in a range of a radial position of the circumferential flow path 40.

The external communication path 50 is connected to both circumferential ends of the circumferential flow path 40 and communicates with the outside of the casing 3. In the present embodiment, the external communication path 50 is connected to both circumferential ends of the circumferential flow path 40 via the connection flow path 60.

The external communication path 50 is formed as a flow path in an external communication pipe 3*a* formed as a portion of the casing 3. As shown in FIG. 3, the outer communication pipe 3*a* is provided to protrude from an outer peripheral surface of the casing 3. The outer communication pipe 3*a* and the external communication path 50 formed in the outer communication pipe 3*a* extend from a portion between both ends of the circumferential flow path 40, that is, a circumferential position except for the region of the angle θ1 in which the circumferential flow path 40 is formed toward a front side in a rotation direction P of the rotary shaft 1 and along a tangential line of the circumferential flow path 40. In the present embodiment, when viewed in the axis O direction, the outer communication pipe 3*a* and the external communication path 50 are provided in a lower left portion.

A diameter of the external communication path 50 gradually increases from the circumferential flow path 40 side toward the outside. In the present embodiment, when viewed in the axis O direction, the external communication path 50 has a first inner wall surface 51 positioned on a rear side in the rotation direction P and a second inner wall surface 52 which is positioned on the other side in the rotation direction P. Each of the first inner wall surface 51 and the second inner wall surface 52 is formed in a flat surface shape. The first inner wall surface 51 and the second inner wall surface 52 are separated from each other from the circumferential flow path 40 side of the external communication path 50 toward the outside. Accordingly, when viewed in the axis O direction, the diameter of the external communication path 50 gradually increase from the circumferential flow path 40 toward the outside. In addition, both wall surfaces 53 of the external communication path 50 in the axis O direction are respectively connected to the first inner wall surface 51 and the second inner wall surface 52. The wall surfaces 53 are disposed to be parallel to each other.

Specifically, as shown in FIG. 3, the connection flow path 60 is a flow path which is connected to the circumferential flow path 40 and the external communication path 50 and is formed in the casing 3. The connection flow path 60 is connected to both ends of the circumferential flow path 40 so as to be interposed therebetween. The connection flow path 60 communicates with the circumferential flow path 40 on both side in the circumferential direction. The connection flow path 60 is formed in the circumferential direction in a range of an angle θ2 (θ2=360°−θ) except for the angle θ1 which is a formation range of the circumferential flow path 40. The connection flow path 60 is connected to communicate with an end portion on the circumferential flow path 40 side of the external communication path 50 on the outer peripheral side.

The connection flow path 60 is defined by a second inner peripheral wall surface 61, a first connection surface 62, a second connection surface 63, a convex curved surface 64, and a pair of axial wall surfaces 65. The second inner peripheral wall surface 61 defines a radially inner end portion of the connection flow path 60. The second inner peripheral wall surface 61 extends in an arc shape over the range of the angle θ2 to have a cylindrical surface shape about the axis O. In the present embodiment, the second inner peripheral wall surface 61 has the same outer diameter as that of the first inner peripheral wall surface 41 and the second inner peripheral wall surface 61 and the first inner peripheral wall surface 41 are continuous to each other. That is, a first inner peripheral wall surface 41 and a second inner peripheral wall surface 61 form an inner peripheral wall surface 31 which extends over the entire circumferential direction to form a circular shape. The first inner peripheral wall surface 41 and the second inner peripheral wall surface 61 are a portion of the inner peripheral wall surface 31.

The first connection surface 62 is connected to one end portion (an end portion on the rear side in the rotation direction P with reference to the region of the angle θ2 of the pair of end portions of the circumferential flow path 40) of the outer peripheral wall surface 42 defining the circumferential flow path 40. The first connection surface 62 has a flat surface shape parallel to the axis O. The first connection surface 62 extends toward the front side in the rotation direction P while coinciding with a tangential line of the outer peripheral wall surface 42 from one end portion of the outer peripheral wall surface 42. The first connection surface 62 is connected to the first inner wall surface 51, which defines the external communication path 50, to be flush with the first inner wall surface 51. That is, the first connection surface 62 connects the outer peripheral wall surface 42 and the first inner wall surface 51 to each other such that the outer peripheral wall surface 42 and the first inner wall surface 51 are linearly continuous with each other when viewed in the axis O direction.

The second connection surface 63 is connected to the other end portion (an end portion on the front side in the rotation direction P with reference to the region of the angle θ2 of the pair of end portions of the circumferential flow path 40) of the outer peripheral wall surface 42 defining the circumferential flow path 40. The second connection surface 63 has a flat surface shape parallel to the axis O. The second connection surface 63 extends toward the rear side in the rotation direction P while coinciding with a tangential line of the outer peripheral wall surface 42 from the other end portion of the outer peripheral wall surface 42.

The convex curved surface 64 is connected to the second wall surface 27*b* defining the second connection surface 63 and the external communication path 50. The convex curved surface 64 has a convex curved surface shape which smoothly connects the second connection surface 63 and the second inner wall surface 52 to each other when viewed in the axis O direction. In the present embodiment, when viewed in the axis O direction, a curvature radius R of the convex curved surface 64 is constant from a connection location with the second connection surface 63 to a connection location with the second inner wall surface 52. That is, the convex curved surface 64 has an arc shape when viewed in the axis O direction, and both ends thereof are continuously connected to the second connection surface 63 and the second inner wall surface 52 of the external communication path 50.

The pair of axial wall surface 65 defines the end portions of the connection flow path 60 in the axis O direction. In the axial wall surface 65 on one side in the axis O direction of the pair of axial wall surface 65, a slit 66 is formed, which has the same radial dimension as an opening of the circumferential flow path 40 to the return flow path 25 and is opened in an arc shape. A circular opening portion 32 having an annular shape over the entire region in the circumferential direction is formed by the arc-shaped opening portion 44 of the circumferential flow path 40 and the slit 66.

In the present embodiment, the axially arcuate wall surface 43 defining the circumferential flow path 40, the axial wall surface 65 on the other side in the axis O direction defining the connection flow path 60, and the wall surface 53 on the other side in the axis O direction of the external communication path 50 are positioned in a flat surface shape orthogonal to the axis O and are flush with other. Moreover, the axial wall surface 65 on one side in the axis O direction defining the connection flow path 60 and the wall surface 53 on the one side in the axis O direction of the external communication path 50 are positioned in a flat surface shape orthogonal to the axis O and are flush with each other.

Accordingly, any portion of a flow path cross-sectional shape in the suction-and-discharge flow path 30 has a rectangular shape.

In the present embodiment, in a case where the radial dimension of the circumferential flow path 40 is defined as W, the following Expression (1) is established between the radial dimension W and the curvature radius R of the convex curved surface 64 of the connection flow path 60.

$$W \leq R \leq 3W \quad (1)$$

That is, the curvature radius R of the convex curved surface 64 is the radial dimension W of the circumferential flow path 40 to three times the radial dimension W of the circumferential flow path 40.

Here, a flow path cross-sectional area of the circumferential flow path 40, that is, a flow path cross-sectional area of a cross section (including a cross section including a radial direction) orthogonal to a circumferential direction in an extension direction of the circumferential flow path 40 is defined as A. In addition, a throat area is defined as B, which is a minimum flow path cross-sectional area of a portion of the connection flow path 60 with which the convex curved surface 64 comes into contact. Here, as shown in FIG. 4, when viewed in the axis O direction, the throat area means a flow path cross-sectional area including a minimum diameter when a circle which comes into contact with the convex curved surface 64 and has a diameter less than that of the flow path is drawn. In other words, an area of the flow path on a virtual plane which is parallel to the axis O and includes the diameter of the circle becomes the throat area. In the present embodiment, the flow path cross section of the suction-and-discharge flow path 30 is a rectangular shape, and thus, a product of the diameter of the circle and the dimension of the flow path in the axis O direction becomes the throat area.

In the present embodiment, the following Expression (2) is established between the flow path cross-sectional area A of the circumferential flow path 40 and the throat area B where the convex curved surface 64 is in contact.

$$2A \leq B \leq 5$$

That is, the throat area B is two times the flow path cross-sectional area A of the circumferential flow path 40 to five times the flow path cross-sectional area A of the circumferential flow path 40.

The centrifugal compressor 100 having the above-described configuration is used as a compressor of a turbo refrigerator. The turbo refrigerator has a refrigeration cycle in which a compressor, an evaporator, an expansion valve, and a condenser through which a refrigerant serving as the working fluid flows are sequentially connected to each other.

Depending on an operation process of the turbo refrigerator, it may be necessary to switch a state where the working fluid is discharged from the intermediate flow path 23 to the outside during the operation and a state where the working fluid is sucked from the outside into the intermediate flow path 23.

In the centrifugal compressor 100 of the present embodiment, according to the above-described configuration, it is possible to discharge the working fluid from the intermediate flow path 23 between the preceding stage impeller 4 and the subsequent stage impeller 4 to the outside via the suction-and-discharge flow path 30. In addition, it is possible to suck the working fluid into the intermediate flow path 23 via the suction-and-discharge flow path 30 from the outside. That is, the suction-and-discharge flow path 30 is used for both discharge and suction of the refrigerant. Accordingly, compared to a case where the flow path for discharge and the flow path for suction are separately provided, the suction can be simplified.

Here, in general, the flow path cross-sectional area of the discharge flow path increases toward the front side in the rotation direction P of the rotary shaft 1 while the working fluid in the intermediate flow path 23 is introduced from the entire region of the discharge flow path in the circumferential direction, and thereafter, the discharge flow path communicates with the outside. Accordingly, when the working fluid is discharged from the intermediate flow path 23, the flow path cross-sectional area increases according to an increase in a flow rate of the working fluid toward the front side in the rotation direction P. Accordingly, a low pressure loss is generated.

However, in a case where the discharge flow path tries to be used as the suction flow path, that is, in a case where the working fluid tries to be sucked from the outside via the discharge flow path, the flow path cross-sectional area in the discharge flow path decreases as the working fluid flows. Accordingly, as the working fluid flows in from the outside, a pressure loss increases. Therefore, it is not possible to suck the working fluid from the entire region in the circumferential direction to the intermediate flow path 23. As a result, the amount of suction at a circumferential position is biased, and thus, a pressure loss increases.

Meanwhile, in the present embodiment, the flow path cross-sectional area of the circumferential flow path 40 communicating with the intermediate flow path 23 in the suction-and-discharge flow path 30 is uniform. Accordingly, when the working fluid is discharged from the intermediate flow path 23, it is possible to decrease the pressure loss when the working fluid is sucked into the intermediate flow path 23 while preventing the pressure loss from increasing.

That is, in a case where the suction-and-discharge flow path 30 is used for discharge, for example, compared to a case where the flow path cross-sectional area of the circumferential flow path 40 decreases toward the front side in the rotation direction P, the pressure loss decreases. Accordingly, it is possible to prevent the pressure loss when the working fluid is discharged from increasing. Meanwhile, in a case where the suction-and-discharge flow path 30 is used for suction, as the working flow flows in from the outside, the flow path cross-sectional area of the circumferential flow path 40 does not decrease. Accordingly, it is possible to prevent the amount of suction at the circumferential position from being deviated. Therefore, the suction-and-discharge flow path 30 is adopted, and thus, it is possible to decrease the pressure losses of both the discharge of the working fluid from the intermediate flow path 23 and the suction of the working fluid into the intermediate flow path 23.

Here, in a case where the external communication path 50 and the circumferential flow path 40 in the suction-and-discharge flow path 30 are connected to each other at an acute angle when viewed in the axis O direction, when the working fluid is sucked from the outside, inflow of the working fluid from the external communication path 50 to the circumferential flow path 40 is hindered at the connection location. As a result, the pressure loss increases. In the present embodiment, the connection location between the external communication portion and the circumferential flow path 40 becomes the convex curved surface 64. Accordingly, it is possible to decrease the pressure loss in a case where the working fluid is sucked.

In addition, particularly, in the present aspect, the relationship of $W \leq R \leq 3W$ is established between the curvature radius R of the convex curved surface 64 and the radial dimension W of the circumferential flow path 40. That is, the curvature of the convex curved surface 64 is suppressed. Accordingly, the working fluid can be smoothly introduced from the external communication path 50 to the circumferential flow path 40. That is, it is possible to further prevent the working fluid from being hindered by the connection location, and it is possible to effectively suppress the pressure loss at the time of the suction.

Here, a location at which the convex curved surface 64 exists becomes a junction location between the external communication path 50 and the circumferential flow path 40. In a case where the suction-and-discharge flow path 30 is used for suction, it is preferable to make the flow path cross-sectional area at the junction portion as large as possible. Accordingly, it is possible to decrease a dynamic pressure of the working fluid via the external communication path 50, and as a result, the working fluid is easily introduced into both side of the external communication path 50 in the circumferential direction, and it is possible to suppress the biasing of the amount of suction in the circumferential direction.

In the present embodiment, the relationship is established between the throat area B having the minimum flow path cross-sectional area at the junction portion where the convex curved surface 64 is in contact and the flow path cross-sectional area A of the flow path in the flow direction. Accordingly, the flow path cross-sectional area at the junction location is largely secured. Therefore, it is possible to effectively decrease the dynamic pressure of the working fluid introduced from the outside at the junction location.

Here, in a case where the inner peripheral wall surface 31 of the circumferential flow path 40 is connected to the straight flow path 27, the working fluid sucked from the outside is introduced into the straight flow path 27, and thus, a mixing loss increases. That is, a speed component of the working fluid flowing through the straight flow path 27 and a speed component of the working fluid flowing through the circumferential flow path 40 are largely different from each other. Accordingly, the working fluids collide with each other, and thus, the mixing loss increases. In the present embodiment, the inner peripheral wall surface 31 of the circumferential flow path 40 is connected to the straight flow path 27 through which the working fluid, which has a small speed component relative to the working fluid flowing through the circumferential flow path 40, flows. Accordingly, it is possible to decrease the mixing loss.

Moreover, in the present embodiment, the external communication path 50 extends from a portion between both ends of the circumferential flow path 40 toward the front side in the rotation direction P and along the tangential line of the circumferential flow path 40. Accordingly, particularly, the working fluid, which is discharged from the intermediate flow path 23 and flows through the circumferential flow path 40 along the rotation direction P, is easily discharged to the outside. That is, in the present embodiment, in the suction and the discharge, particularly, it is possible to decrease the pressure loss when the working fluid is discharged. Therefore, the present embodiment is suitable for the operation process in which a discharge frequency of the working fluid is higher than a suction frequency of the working fluid.

Figure 5:
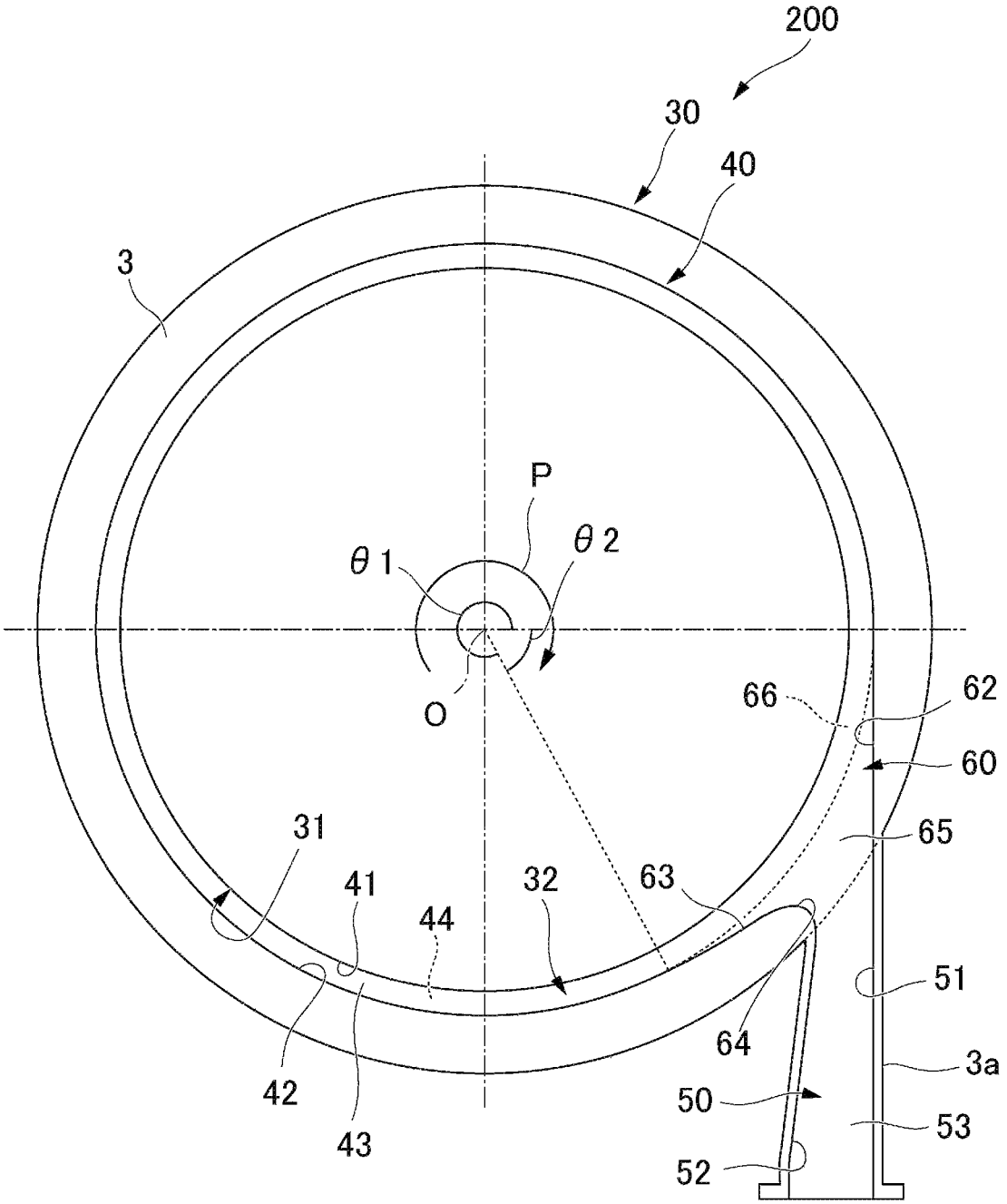
FIG. 5 is a sectional view perpendicular to an axial of a suction-and-discharge flow path of a centrifugal compressor according to a second embodiment.

Next, a second embodiment of the present invention will be described with reference to FIG. 5. In the second embodiment, the same reference numerals are assigned to the same components as those of the first embodiment, and repeated descriptions are omitted. In the suction-and-discharge flow path 30 of a centrifugal compressor 200 of the second embodiment, the external communication path 50 and the connection flow path 60, which are provided at the lower left when viewed from one side in the axis O direction, are provided at the lower right when viewed from one side in the axis O direction. That is, when viewed in a cross-sectional view orthogonal to the axis O, the suction-and-discharge flow path 30 of the second embodiment is linearly symmetrical to the suction-and-discharge flow path 30 of the first embodiment with a vertical line passing through the axis O as a line of symmetry. In other words, the suction-and-discharge flow path 30 of the first embodiment and the suction-and-discharge flow path 30 of the second embodiment are right-left symmetrical to each other.

For example, the angle θ1 in the circumferential direction in which the circumferential flow path 40 exists is 270° to 350°, and preferably, 300° to 340°. In the present embodiment, the angle θ1 is set to 330°. The angle θ2 at which the connection flow path 60 exists is a value obtained by subtracting the angle θ1 from 360°.

Accordingly, the external communication path 50 of the second embodiment extends from a portion between both ends of the circumferential flow path 40 toward the rear side in the rotation direction P and along the tangential line of the circumferential flow path 40. Accordingly, particularly, the working fluid, which is sucked via the outer communication pipe 3*a* from the outside and flows through the circumferential flow path 40 in the rotation direction P, is easily taken into the inside. Therefore, in the suction and the discharge, particularly, it is possible to decrease the pressure loss when the working fluid is sucked. Therefore, the present embodiment is suitable for the operation process in which the suction frequency of the working fluid is higher than the discharge frequency of the working fluid.

Figure 6:
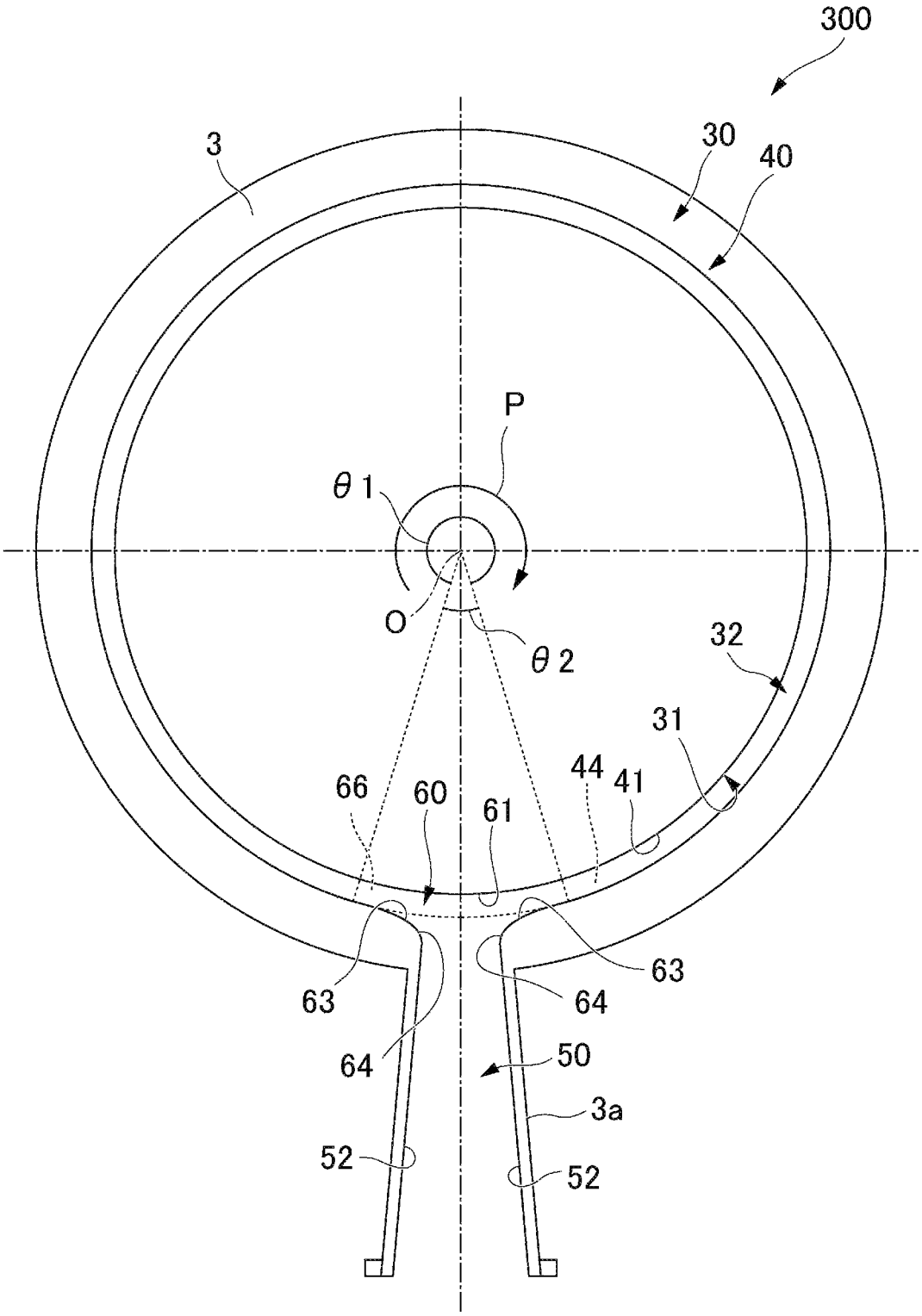
FIG. 6 is a sectional view perpendicular to an axial of a suction-and-discharge flow path of a centrifugal compressor according to a third embodiment.

Next, a third embodiment of the present invention will be described with reference to FIG. 6. In the third embodiment, the same reference numerals are assigned to the same components as those of the first and second embodiments, and repeated descriptions are omitted. In the suction-and-discharge flow path 30 of a centrifugal compressor 100 of the third embodiment, the external communication path 50 is provided below the axis O. That is, a center axis O of the external communication path 50 in the cross section orthogonal to the axis O coincides with the axis O in a vertical direction and passes through the axis O. In addition, the convex curved surfaces 64 are continuously connected to both the pair of inner wall surfaces 52 and 52 of the external communication path 50, respectively.

Accordingly, in the third embodiment, the working fluid sucked via the external communication path 50 is introduced to both side in the circumferential direction along the convex curved surfaces 64 on both side in the circumferential direction, at a low pressure loss. Accordingly, the suction of the working fluid can be more uniformly performed in the circumferential direction.

Hereinbefore, the embodiments of the present invention are described. However, the present invention is not limited to this, and the embodiments can be appropriately modified within a scope which does not depart from a technical idea of the invention.

For example, the connection flow path 60 is provided between the circumferential flow path 40 and the external communication path 50. However, the circumferential flow path 40 and the external communication path 50 may be directly connected to each other without through the connection flow path 60. Even in this case, it is preferable that the convex curved surfaces 64 are provided at both connection locations.

In the embodiments, the circumferential flow path 40 of the suction-and-discharge flow path 30 is connected to the intermediate flow path 23 between the second stage impeller 4 and the third stage impeller 4. However, the circumferential flow path 40 may be connected to other intermediate pipe flow paths or may be connected to each intermediate flow path 23.

Moreover, the circumferential flow path 40 may have any configuration as long as at least the first inner peripheral wall surface 41 is connected to the straight flow path 27. In the embodiment, the outer peripheral wall surface 42 is connected to the return bend portion 26. However, the outer peripheral wall surface 42 is also connected to the straight flow path 27.

INDUSTRIAL APPLICABILITY

According to a multi-stage centrifugal compressor and a turbo refrigerator, it is possible to cope with various operation processes and maintain a low pressure loss while avoiding complication of a structure.

REFERENCE SIGNS LIST

1: rotary shaft
2: flow path
3: casing
3*a:* outer communication pipe
4: impeller
5: journal bearing
6: thrust bearing
7: intake port
8: exhaust port
21: suction flow path
22: compression flow path
23: intermediate flow path
24: diffuser flow path
25: return flow path
26: return bend portion
26*a:* inner curved surface
26*b:* outer curved surface
27: straight flow path
27*a:* first wall surface
27*b:* second wall surface
28: return vane
30: suction-and-discharge flow path
31: inner peripheral wall surface
32: circular opening portion
40: circumferential flow path
41: first inner peripheral wall surface
42: outer peripheral wall surface
43: axially arcuate wall surface
44: arc-shaped opening portion
50: external communication path
51: first inner wall surface (inner wall surface)
52: second inner wall surface (inner wall surface)
53: wall surface
60: connection flow path
61: second inner peripheral wall surface
62: first connection surface
63: second connection surface
64: convex curved surface
65: axial wall surface
66: slit
100: centrifugal compressor
200: centrifugal compressor
300: centrifugal compressor
O: axis
P: rotation direction
G: working fluid
A: flow path cross-sectional area

What is claimed is:

1. A centrifugal compressor comprising:

a rotary shaft which is configured to rotate around an axis;

impellers which arranged to form a plurality of stages with respect to the rotary shaft in an axis direction and are configured to pressure-feed a fluid flowing in from an inlet on one side in the axis direction radially outward; and a casing which surrounds the rotary shaft and the impellers and has an intermediate flow path through which the fluid discharged from a preceding stage impeller of the impellers adjacent to each other is introduced into a subsequent stage impeller and a suction-and-discharge flow path which connects the intermediate flow path to an outside of the centrifugal compressor, wherein the suction-and-discharge flow path includes a circumferential flow path which extends in an arc shape about the axis in a circumferential direction of the axis and communicates with the intermediate flow path in the circumferential direction, an external communication path which communicates with the outside, and a connection flow path which connects both circumferential ends of the circumferential flow path with one end of the external communication path, wherein a flow path cross-sectional area of the circumferential flow path is uniform in the circumferential direction, wherein a convex curved surface having a convex curved surface shape continuous to an inner wall surface of the external communication path when viewed in the axis direction is provided between an outer peripheral wall surface of the circumferential flow path and the inner wall surface, wherein in a case where, when viewed in the axis direction, a curvature radius of the convex curved surface is defined as R and a radial dimension of the circumferential flow path is defined as W, a relationship of $W \leq R \leq 3W$ is established, wherein wall surfaces of the connection flow path in the axis direction are flush with wall surfaces of the circumferential flow path in the axis direction, and wherein wall surfaces of the external communication path in the axis direction are flush with the wall surfaces of the connection flow path at the one end.

2. The centrifugal compressor according to claim 1, wherein in a case where the flow path cross-sectional area of the circumferential flow path is defined as A, and a throat area which is a minimum flow path cross-sectional area of a flow path with which the convex curved surface is in contact in the suction-and-discharge flow path is defined as B, a relationship of $2A \leq B \leq 5A$ is established.

3. The centrifugal compressor according to claim 1, wherein the intermediate flow path includes a diffuser flow path which extends radially outward from the preceding stage impeller, a return bend portion which is connected to a downstream side of the diffuser flow path and is curved radially inward, and a straight flow path which is connected to a downstream side of the return bend portion and extends radially inward, and wherein an inner peripheral wall surface of the circumferential flow path is connected to the straight flow path in the circumferential direction.

4. The centrifugal compressor according to claim 1, wherein the external communication path extends from a portion between both ends of the circumferential flow path toward a front side in a rotation direction of the rotary shaft and along a tangential line of the circumferential flow path, and wherein the convex curved surface is formed between the outer peripheral wall surface and the inner wall surface on the front side in the rotation direction.

5. The centrifugal compressor according to claim 1, wherein the external communication path extends from a portion between both ends of the circumferential flow path toward a rear side in a rotation direction of the rotary shaft and along a tangential line of the circumferential flow path, and wherein the convex curved surface is formed between the outer peripheral wall surface and the inner wall surface on the rear side in the rotation direction.

6. The centrifugal compressor according to claim 1, wherein the external communication path extends radially outward from a portion between both ends of the circumferential flow path, and wherein the convex curved surface is formed between the outer peripheral wall surface and the inner wall surface on a front side in a rotation direction of the rotary shaft, and between the outer peripheral wall surface and the inner wall surface on a rear side in the rotation direction.

7. A turbo refrigerator comprising:

the centrifugal compressor according to claim 1.

8. The centrifugal compressor according to claim 2, wherein the intermediate flow path includes a diffuser flow path which extends radially outward from the preceding stage impeller, a return bend portion which is connected to a downstream side of the diffuser flow path and is curved radially inward, and a straight flow path which is connected to a downstream side of the return bend portion and extends radially inward, and wherein an inner peripheral wall surface of the circumferential flow path is connected to the straight flow path in the circumferential direction.

9. The centrifugal compressor according to claim 2, wherein the external communication path extends from a portion between both ends of the circumferential flow path toward a front side in a rotation direction of the rotary shaft and along a tangential line of the circumferential flow path, and wherein the convex curved surface is formed between the outer peripheral wall surface and the inner wall surface on the front side in the rotation direction.

10. The centrifugal compressor according to claim 3, wherein the external communication path extends from a portion between both ends of the circumferential flow path toward a front side in a rotation direction of the rotary shaft and along a tangential line of the circumferential flow path, and wherein the convex curved surface is formed between the outer peripheral wall surface and the inner wall surface on the front side in the rotation direction.

11. The centrifugal compressor according to claim 2, wherein the external communication path extends from a portion between both ends of the circumferential flow path toward a rear side in a rotation direction of the rotary shaft and along a tangential line of the circumferential flow path, and wherein the convex curved surface is formed between the outer peripheral wall surface and the inner wall surface on the rear side in the rotation direction.

12. The centrifugal compressor according to claim 3, wherein the external communication path extends from a portion between both ends of the circumferential flow path toward a rear side in a rotation direction of the rotary shaft and along a tangential line of the circumferential flow path, and wherein the convex curved surface is formed between the outer peripheral wall surface and the inner wall surface on the rear side in the rotation direction.

13. The centrifugal compressor according to claim 2, wherein the external communication path extends radially outward from a portion between both ends of the circumferential flow path, and wherein the convex curved surface is formed between the outer peripheral wall surface and the inner wall surface on a front side in a rotation direction of the rotary shaft, and between the outer peripheral wall surface and the inner wall surface on a rear side in the rotation direction.

14. The centrifugal compressor according to claim 3, wherein the external communication path extends radially outward from a portion between both ends of the circumferential flow path, and wherein the convex curved surface is formed between the outer peripheral wall surface and the inner wall surface on a front side in a rotation direction of the rotary shaft, and between the outer peripheral wall surface and the inner wall surface on a rear side in the rotation direction.

* * * * *